US008644735B2

(12) United States Patent
Kuriki

(10) Patent No.: US 8,644,735 B2
(45) Date of Patent: Feb. 4, 2014

(54) CARTRIDGE CAPABLE OF VARYING RATIO OF CIRCUMFERENTIAL SPEEDS OF SUPPLY ROLLER TO DEVELOPING ROLLER

(75) Inventor: Hirofumi Kuriki, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 136 days.

(21) Appl. No.: 13/359,564

(22) Filed: Jan. 27, 2012

(65) Prior Publication Data

US 2012/0195634 A1 Aug. 2, 2012

(30) Foreign Application Priority Data

Jan. 28, 2011 (JP) ..... 2011-016370

(51) Int. Cl.
*G03G 15/00* (2006.01)

(52) U.S. Cl.
USPC ..... 399/167; 399/281

(58) Field of Classification Search
USPC ..... 399/167
See application file for complete search history.

(56) References Cited

U.S. PATENT DOCUMENTS

| | | | | |
|---|---|---|---|---|
| 6,420,807 | B1 * | 7/2002 | Tsujimoto et al. | 310/83 |
| 7,522,860 | B2 | 4/2009 | Shiraki | |
| 8,306,445 | B2 | 11/2012 | Suzuki et al. | |
| 2007/0059038 | A1 | 3/2007 | Shiraki | |
| 2010/0202798 | A1 | 8/2010 | Suzuki et al. | |
| 2011/0058861 | A1 * | 3/2011 | Suzuki | 399/328 |

FOREIGN PATENT DOCUMENTS

| | | | |
|---|---|---|---|
| JP | 09-171339 | | 6/1997 |
| JP | 09-211957 | A | 8/1997 |
| JP | 10-020737 | A | 1/1998 |
| JP | 11-236143 | A | 8/1999 |
| JP | 2002-236421 | A | 8/2002 |
| JP | 2002-268504 | A | 9/2002 |
| JP | 2004-102140 | A | 4/2004 |
| JP | 2007-079139 | | 3/2007 |
| JP | 2010-186071 | A | 8/2010 |

OTHER PUBLICATIONS

Office Action issued in corresponding Japanese Patent Application No. 2011-016370 mailed May 14, 2013.
Office Action issued in corresponding Japanese Patent Application No. 2011-016370 dated Jan. 29, 2013.

* cited by examiner

*Primary Examiner* — Walter L Lindsay, Jr.
*Assistant Examiner* — Roy Y Yi
(74) *Attorney, Agent, or Firm* — Banner & Witcoff, Ltd.

(57) ABSTRACT

A cartridge includes a developing roller, supply roller, input rotary body, developing roller rotary body, and supply roller rotary body. The developing roller/supply roller rotary bodies transmit the drive force inputted from the input rotary body to the developing roller/supply roller, respectively. The developing roller rotary body includes first and second drive input parts having different diameters. The input rotary body includes first and second drive output parts engaged with the first and second drive input part, respectively and having different diameters. The first drive output part is movable between a first position and second position. The first drive input part and the first drive output part are engaged when the first drive output part is in the first position. The second drive input part and the second drive output part are engaged when the first drive output part is in the second position.

9 Claims, 7 Drawing Sheets

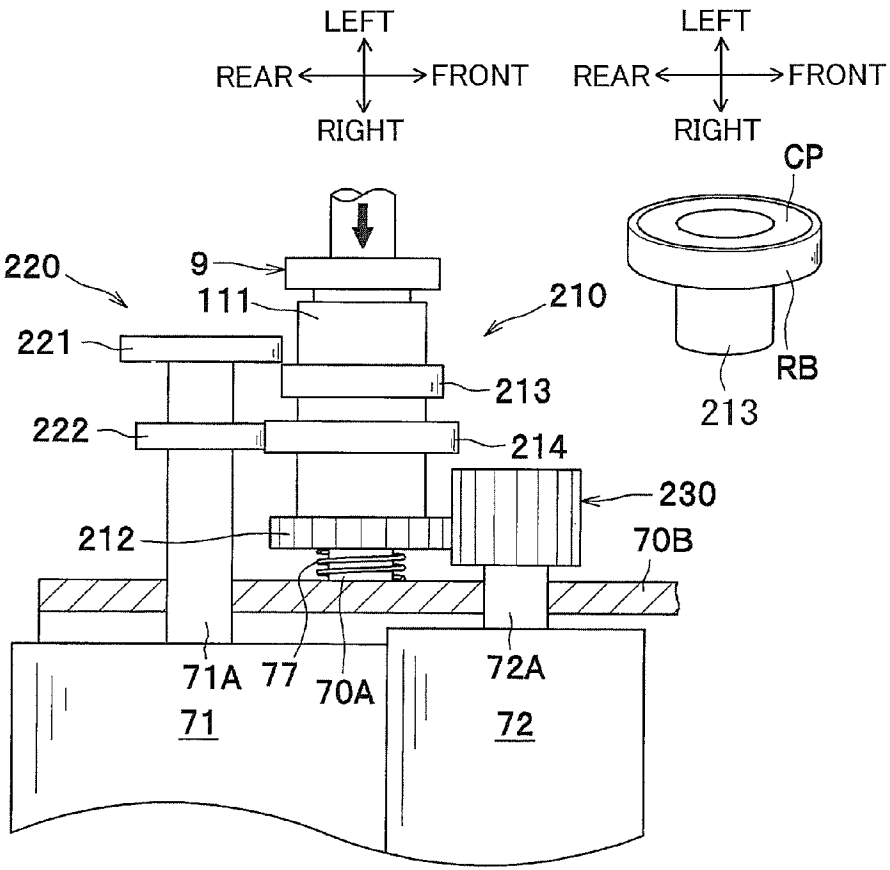
FIG.6(c)
FIG.6(b)
LEFT
RIGHT
FRONT
REAR
CP
RB
213
230
70B
210
214
72A
72
70A
77
9
111
71A
71
220
221
222
212
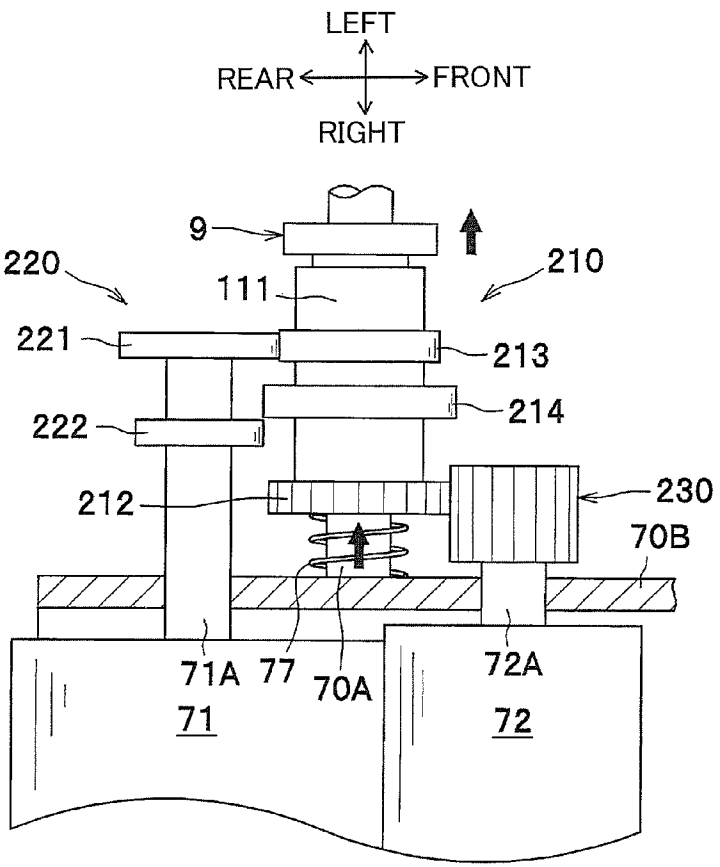
FIG.6(a)
LEFT
RIGHT
FRONT
REAR
230
70B
210
213
214
72A
72
70A
77
9
111
71A
71
220
221
222
212

CARTRIDGE CAPABLE OF VARYING RATIO OF CIRCUMFERENTIAL SPEEDS OF SUPPLY ROLLER TO DEVELOPING ROLLER

CROSS REFERENCE TO RELATED APPLICATION

This application claims priority from Japanese Patent Application No. 2011-016370 filed Jan. 28, 2011. The entire content of the priority application is incorporated herein by reference.

TECHNICAL FIELD

The present invention relates to a cartridge detachably mounted in an image forming device.

BACKGROUND

Developer cartridges that are detachably mounted in an image-forming device, such as a color printer, are well known in the art. One such developer cartridge includes a developing roller for carrying a developer, and a supply roller for supplying developer to the developing roller. The developer cartridge also includes an input gear; and a developing roller drive gear and a supply roller drive gear engaged with the input gear. By transmitting a drive force to the input gear from a source outside the cartridge, the developing roller and supply roller are driven to rotate through the developing roller drive gear and supply roller drive gear.

Since the developing roller and supply roller are in sliding contact with each other, the ratio of circumferential speeds of supply roller to developing roller has an effect on image quality, the lifespan of the developer, and the like. Specifically, a high ratio of circumferential speeds (hereinafter, the "ratio of circumferential speeds" will refer to the ratio of the circumferential speed of the supply roller to the circumferential speed of the developing roller) can improve image quality since the supply roller has a heightened ability to scrape off residual developer from the surface of the developing roller. When the ratio of circumferential speeds is low, the life of the developer can be increased since there is less friction on the developer between the developing roller and supply roller.

SUMMARY

However, the conventional developer cartridge described above does not come with any mechanism for modifying the ratio of circumferential speeds of supply roller to developing roller. Hence, if the developing roller and supply roller are configured to always slide against each other at a relatively high circumferential speed ratio, for example, the image-forming device might be forming images of a higher quality than that required by the user, and the life of the developer may be shortened due to unnecessarily applying friction to the developer during warming up operations and other non-image-forming operations. Further, adding a mechanism to existing cartridges in order to vary the circumferential speed ratio can be very difficult.

In view of the foregoing, it is an object of the present invention to provide a cartridge capable of varying the circumferential speed ratio for the developing roller and supply roller.

In order to attain the above and other objects, the invention provides a cartridge including a developing roller, a supply roller, an input rotary body, a developing roller drive rotary body, and a supply roller drive rotary body. The developing roller is configured to carry developer thereon. The supply roller is in sliding contact with the developing roller to supply the developer to the developing roller. The input rotary body is configured to receive a drive force inputted from an image forming device to which the cartridge is detachably mounted. The developing roller drive rotary body is configured to transmit the drive force inputted from the input rotary body to the developing roller. The supply roller drive rotary body is configured to transmit the drive force inputted from the input rotary body to the supply roller. At least one of the developing roller drive rotary body and the supply roller drive rotary body includes a shaft, a first drive input part, and a second drive input part. The shaft extends in a shaft direction. The first drive input part is provided on the shaft and configured to receive the drive force inputted from the input rotary body. The first drive input part has a first rotational transmission diameter. The second drive input part is provided on the shaft at a location different from a location at which the first drive input part is provided. The second drive input part is configured to receive the drive force inputted from the input rotary body. The second drive input part has a second rotational transmission diameter different from the first rotational transmission diameter. The input rotary body includes a first drive output part and a second drive output part. The first drive output part is configured to engage with the first drive input part and transmit the drive force to the first drive input part. The first drive output part has a third rotational transmission diameter and a rotational axis defining an axial direction parallel to the shaft direction. The second drive output part is configured to engage with the second drive input part and transmit the drive force to the second drive input part. The second drive output part is coaxial with the first drive output part and positioned at a position different from a position at which the first drive output part in the axial direction. The second drive output part has a fourth rotational transmission diameter different from the third rotational transmission diameter. At least one of the first drive input part and the first drive output part is movable between a first position and a second position. The second drive input part is movable together with the movement of first drive input part. The second drive output part is movable together with the movement of first drive output part. The first drive input part and the first drive output part are engaged with each other when the at least one of the first drive input part and the first drive output part is positioned at the first position. The second drive input part and the second drive output part are engaged with each other when the at least one of the first drive input part and the first drive output part is positioned at the second position. Here, a "different rotational transmission diameter" denotes that the diameter of mechanisms serving to transmit rotational motion is different between two drive input units or between two drive output units. If the drive input parts or drive output parts are configured of gears, for example, then a different rotational transmission diameter denotes that the number of gear teeth (the pitch circle diameter) differs between drive input units or between drive output units. If the drive input parts or drive output parts are configured of friction wheels, on the other hand, a different rotational transmission diameter denotes a different circumferential length between the drive input units or between the drive output units.

BRIEF DESCRIPTION OF THE DRAWINGS

The particular features and advantages of the invention as well as other objects will become apparent from the following description taken in connection with the accompanying drawings, in which:

FIG. 4(*b*) is an explanatory diagram showing the developing roller, supply roller, input rotary body, developing roller drive rotary body, and supply roller drive rotary body that are provided in the cartridge according to the first embodiment when the input rotary body is positioned at a second position;

FIG. 6(*a*) is an explanatory diagram showing a developing roller, supply roller, input rotary body, developing roller drive rotary body, and supply roller drive rotary body that are provided in the cartridge according to the second embodiment when the input rotary body is positioned at the first position;

FIG. 6(*b*) is an explanatory diagram showing the developing roller, supply roller, input rotary body, developing roller drive rotary body, and supply roller drive rotary body that are provided in the cartridge according to the second embodiment when the input rotary body is positioned at the second position;

FIG. 6(*c*) is a perspective view of a first drive output part of the input rotary body according to the second embodiment;

FIG. 7(*b*) is an explanatory diagram showing the developing roller, supply roller, input rotary body, developing roller drive rotary body, and supply roller drive rotary body that are provided in the cartridge according to the third embodiment when the input rotary body is positioned at the second position.

DETAILED DESCRIPTION

Next, a first embodiment of the present invention will be described while referring to FIGS. 1 through 5. First, the general structure of a laser printer 1, serving as the image-forming device of the present invention, will be described. Then, a detailed structure of a developer cartridge 7 detachably mounted in the laser printer 1 will be described as a feature of the present invention.

Directions given in the following description will be based on the reference of a user operating the laser printer 1. Specifically, the right side of the laser printer 1 in FIG. 1 will be considered the "front," the left side the "rear," the near side the "left side," and the far side the "right side." The "top" and "bottom" of the laser printer 1 in the following description will be based on the vertical direction in FIG. 1.

Figure 1:
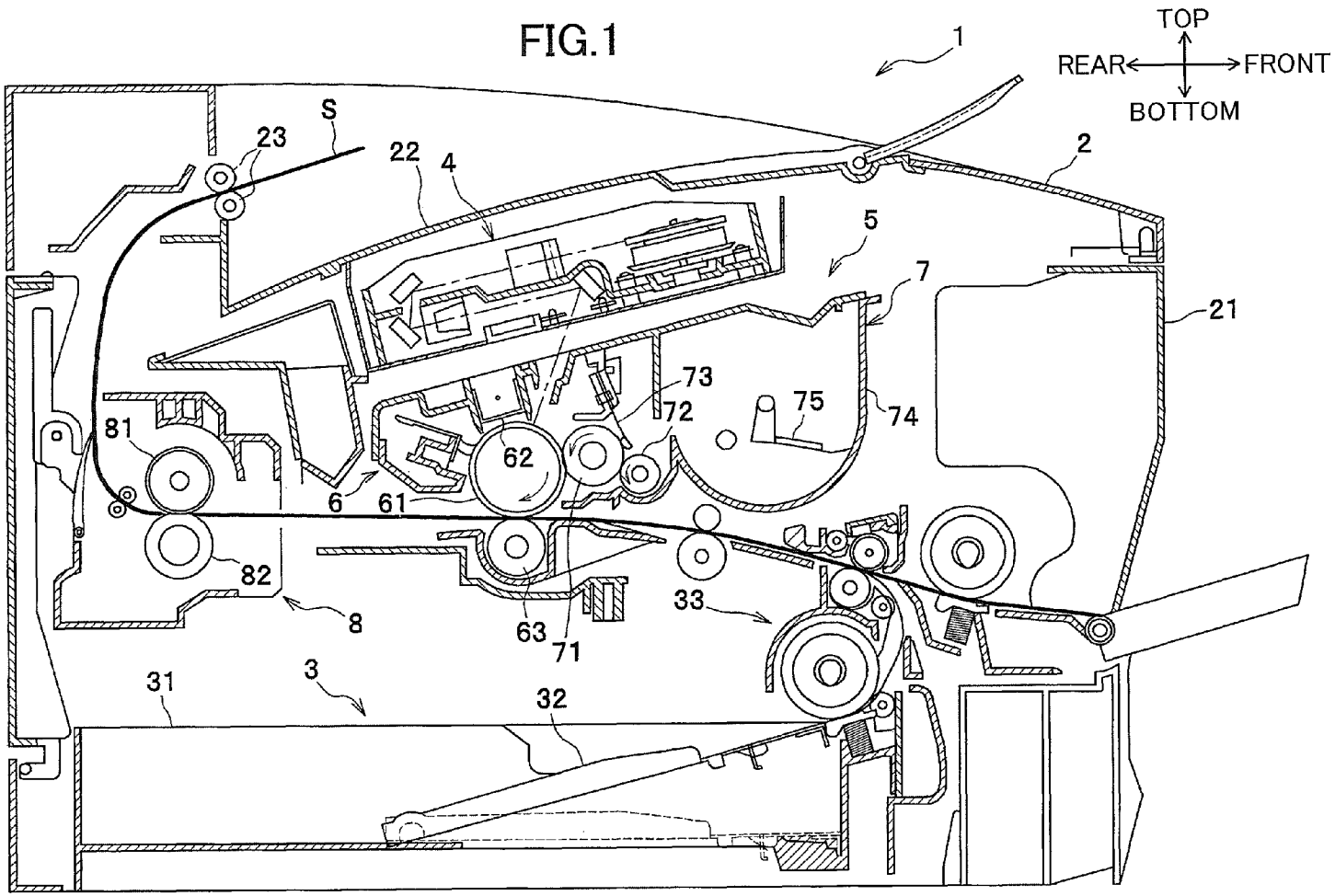
FIG. 1 is a cross-sectional side view of an image forming device including a cartridge according to a first embodiment of the present invention.

As shown in FIG. 1, the laser printer 1 includes a main casing 2 and, within the main casing 2, a feeding unit 3 for supplying sheets S of paper to be printed, an exposure unit 4, a process cartridge 5 for transferring a toner images onto the sheets S, and a fixing unit 8 for fixing the toner images on the sheets S with heat.

The feeding unit 3 is provided in the bottom of the main casing 2 and primarily includes a paper tray 31, a paper-pressing plate 32, and a paper-feeding mechanism 33. The paper tray 31 accommodates the sheets S of paper. The paper-pressing plate 32 pushes the sheets S accommodated in the paper tray 31 upward toward the paper-feeding mechanism 33, and the paper-feeding mechanism 33 supplies the sheets S to the process cartridge 5 (between a photosensitive drum 61 and a transfer roller 63).

The exposure unit 4 is disposed in the top section of the main casing 2 and includes a laser light emitting unit (not shown), as well as a polygon mirror, lenses, reflecting mirrors, and other components for which reference numerals have not been assigned. The laser light emitting unit in the exposure unit 4 emits a laser beam (indicated by a chain line in FIG. 1) based on image data, scanning the laser beam over the surface of the photosensitive drum 61 at a high speed to expose the same.

The process cartridge 5 is provided below the exposure unit 4. A front cover 21 provided on the front side of the main casing 2 can be opened to reveal an opening through which the process cartridge 5 can be mounted in or removed from the main casing 2 (see FIG. 2). The process cartridge 5 is configured of a drum unit 6 and a developer cartridge 7.

Figure 2:
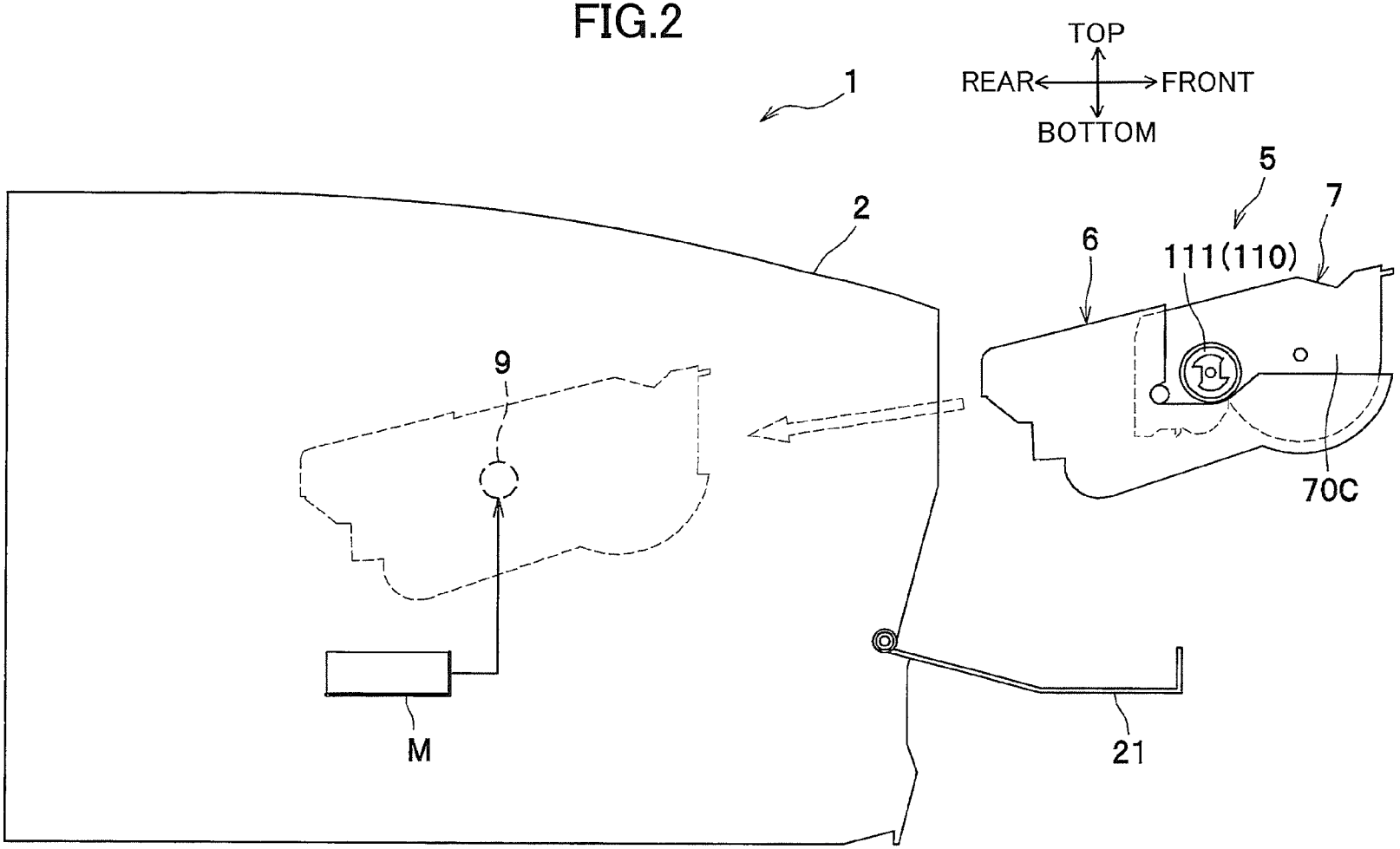
FIG. 2 is an explanatory diagram showing how to mount the cartridge into the image forming device according to the first embodiment.

The developer cartridge 7 is detachably mounted on the drum unit 6. As shown in FIG. 2, the developer cartridge 7 can be detachably mounted in the main casing 2 after being mounted on the drum unit 6. Returning to FIG. 1, the developer cartridge 7 primarily includes a developing roller 71, a supply roller 72 and a thickness-regulating blade 73 in sliding contact with the developing roller 71, a toner-accommodating section 74 for accommodating toner, and an agitator 75.

In the developer cartridge 7 having this construction, first the agitator 75 agitates toner inside the toner-accommodating section 74, then the supply roller 72 supplies toner to the developing roller 71 as both the developing roller 71 and supply roller 72 rotate. While the developing roller 71 continues to rotate, toner supplied to the surface thereof passes under the thickness-regulating blade 73, and the thickness-regulating blade 73 regulates the toner carried on the developing roller 71 to a uniform thin layer.

The drum unit 6 primarily includes the photosensitive drum 61, a charger 62, and the transfer roller 63. With this drum unit 6, the charger 62 applies a uniform charge to the surface of the photosensitive drum 61, and the charged surface is subsequently exposed by a laser beam emitted from the exposure unit 4, forming an electrostatic latent image on the surface of the photosensitive drum 61.

Next, toner carried on the surface of the developing roller 71 is supplied to the electrostatic latent image formed on the surface of the photosensitive drum 61 to produce a toner image thereon. The toner image formed on the surface of the photosensitive drum 61 is subsequently transferred to a sheet S as the sheet S is conveyed between the photosensitive drum 61 and transfer roller 63.

The fixing unit 8 is disposed on the rear side of the process cartridge 5. The fixing unit 8 primarily includes a heating roller 81, and a pressure roller 82 disposed in confrontation with the heating roller 81 and applying pressure to the same. The fixing unit 8 having this construction, fixes a toner image transferred onto the sheet S with heat as the sheet S passes between the heating roller 81 and pressure roller 82. After the toner image is fixed to the sheet S, discharge rollers 23 discharge the sheet S into a discharge tray 22.

Figure 3:
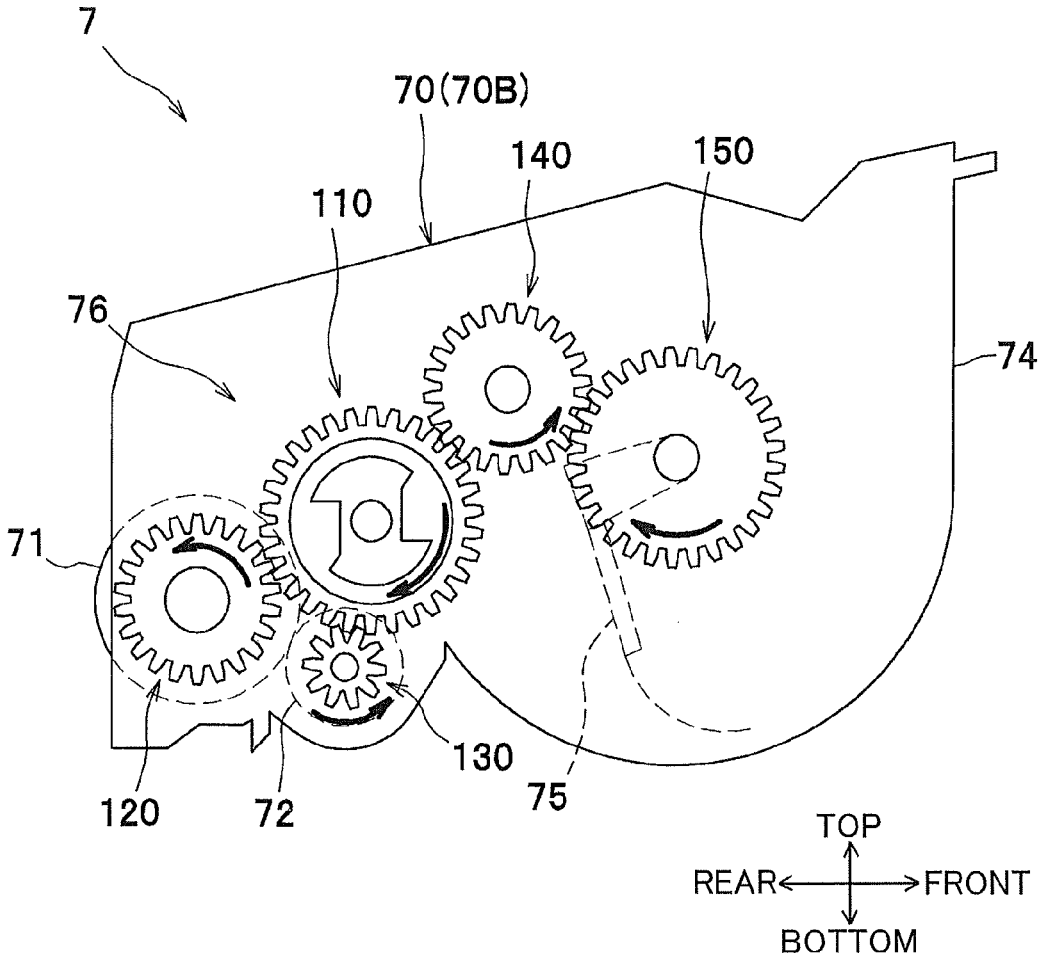
FIG. 3 is a side view of the cartridge according to the first embodiment when a cover is removed.

As shown in FIG. 3, the developer cartridge 7 includes a case 70, a drive transmission mechanism 76, and a coil spring 77 (see FIG. 4), in addition to the developing roller 71, supply roller 72, and the like described above.

The case 70 primarily includes a main cartridge body 70B, and a cover member 70C (see FIG. 2). The main cartridge body 70B supports the developing roller 71, supply roller 72, and the like and defines the toner-accommodating section 74 therein. As shown in FIG. 2, the cover member 70C is attached to the left side surface of the main cartridge body 70B so as to cover the drive transmission mechanism 76, except for parts that must be exposed, including an input gear (input rotary body) 110 and an input coupling 111 described later.

As shown in FIG. 3, the drive transmission mechanism 76 is provided on the left side surface of the main cartridge body 70B. The drive transmission mechanism 76 is a mechanism for transmitting a drive force inputted from the laser printer 1 to the developing roller 71, supply roller 72, and agitator 75. The drive transmission mechanism 76 primarily includes an input gear 110, a developing roller drive gear 120, a supply roller drive gear 130, an intermediate gear 140, and an agitator drive gear 150.

Figure 4B:
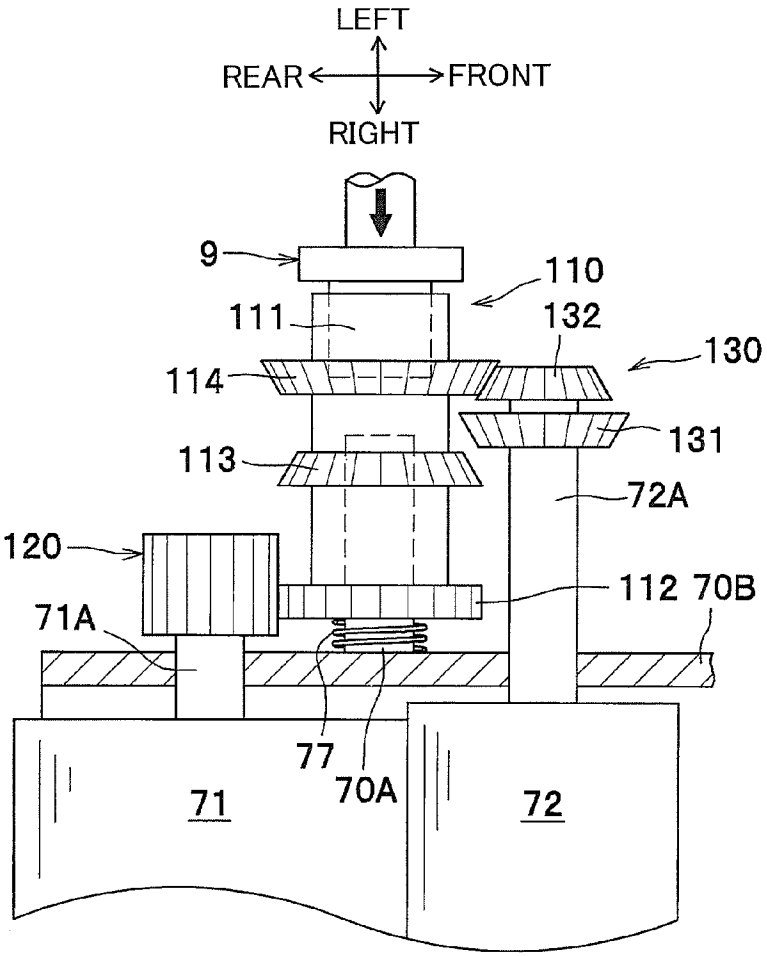
FIG. 4(*a*) is an explanatory diagram showing a developing roller, supply roller, input rotary body, developing roller drive rotary body, and supply roller drive rotary body that are provided in the cartridge according to the first embodiment when the input rotary body is positioned at a first position.
Figure 4A:
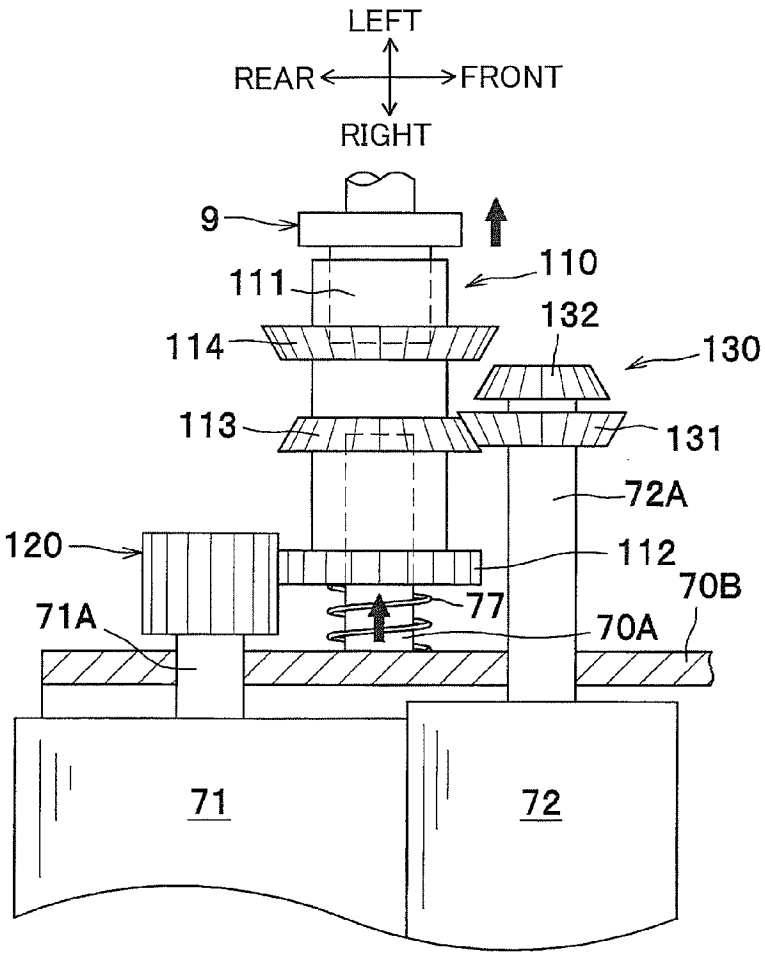

As shown in FIGS. 4(*a*) and 4(*b*), the input gear 110 is a rotary body that receives a drive force inputted from the main casing 2 (the laser printer 1). The input gear 110 primarily includes an input coupling 111, an output gear part 112, a first drive output part 113, and a second drive output part 114. For convenience sake, the input gear 110, developing roller drive gear 120, and supply roller drive gear 130 are depicted in a straight alignment in FIG. 4.

The input coupling 111 is a substantially cylindrical shaft coupling configured to engage with an output coupling 9 in the body of the laser printer 1 described later. The output gear part 112, first drive output part 113, and second drive output part 114 are disposed around the circumference of the input coupling 111. A generally columnar boss 70A protrudes from the left side surface of the main cartridge body 70B. When engaged to the boss 70A, the input coupling 111 is supported thereon so as to be capable of rotating and sliding axially relative to the main cartridge body 70B. Accordingly, the input gear 110 can rotate and slide axially relative to the main cartridge body 70B.

The coil spring 77 is mounted around the boss 70A between the input coupling 111 (input gear 110) and the main cartridge body 70B. The coil spring 77 urges the input gear 110 axially toward the outside of the developer cartridge 7 (the left side; hereinafter simply referred to as the "outside") at least when the input gear 110 is in a second engaging position shown in FIG. 4(*b*).

Grease (a lubricant; not shown) is retained between the input gear 110 and coil spring 77. Since the grease reduces the sliding resistance between the input gear 110 and coil spring 77, the input gear 110 can rotate more suitably.

The output gear part 112 is a gear part having teeth formed around its periphery. The output gear part 112 is disposed on the right end of the input coupling 111. By engaging directly with the developing roller drive gear 120, the output gear part 112 can transmit a drive force inputted into the input coupling 111 to the developing roller drive gear 120. While not shown in the drawings, the output gear part 112 is also engaged with the agitator drive gear 150 via the intermediate gear 140 for transmitting a drive force inputted into the input gear 110 to the agitator drive gear 150.

The first drive output part 113 is a gear part having teeth formed around its periphery. The first drive output part 113 is disposed outside the output gear part 112. The first drive output part 113 engages with a first drive input part 131 (described later) of the supply roller drive gear 130 when the input gear 110 is in a first engaging position shown in FIG. 4(*a*) for transmitting a drive force inputted into the input gear 110 to the supply roller drive gear 130. The first drive output part 113 defines an axial direction parallel to a direction in which a rotational shaft 72A (described later) of the supply roller 72 extends.

The second drive output part 114 is a gear part having teeth formed around its periphery. The second drive output part 114 is disposed adjacent to and outside the first drive output part 113. The second drive output part 114 engages with a second drive input part 132 described later of the supply roller drive gear 130 when the input gear 110 is in the second engaging position shown in FIG. 4(*b*) to transmit a drive force inputted into the input gear 110 to the supply roller drive gear 130. The second drive output part 114 is coaxial with the first drive output part 113 and positioned at a position different from a position at which the first drive output part 113 in the axial direction.

Figure 5:
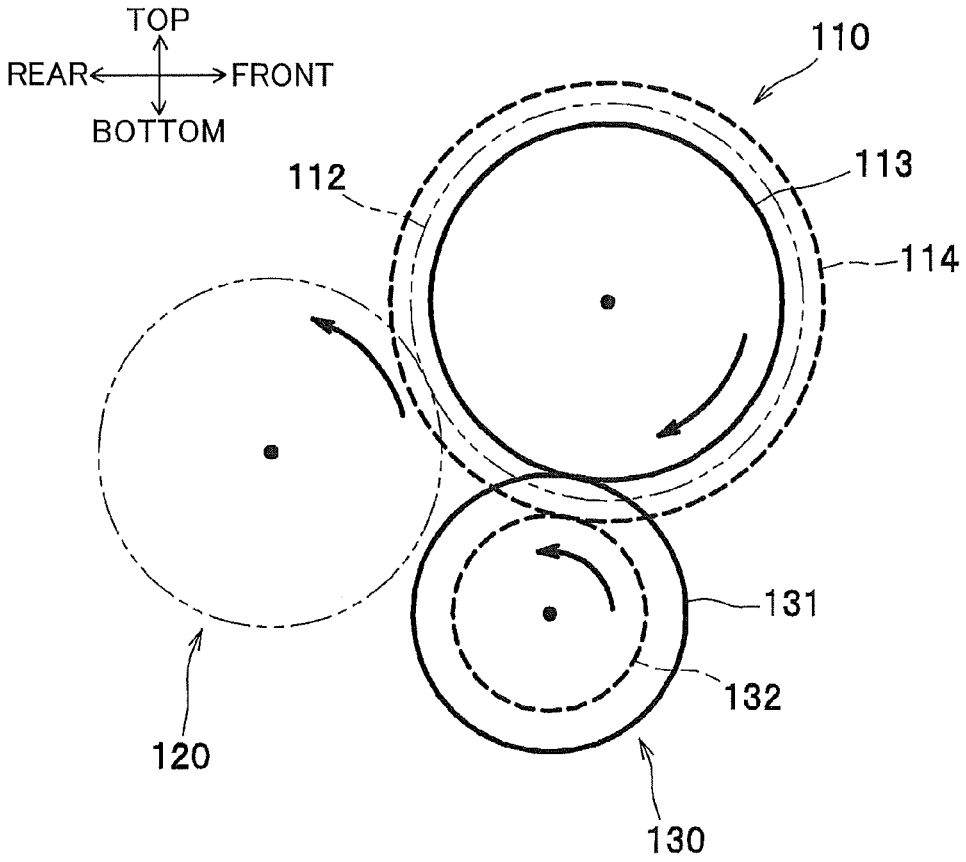
FIG. 5 is an explanatory diagram showing engaging relationships among the input rotary body, developing roller drive rotary body, and supply roller drive rotary body that are provided in the cartridge according to the first embodiment.

As shown in FIG. 5, the first drive output part 113 and second drive output part 114 have different diameters of rotational transmission (different pitch circle diameters). Consequently, the first drive output part 113 and second drive output part 114 have a different number of teeth around their peripheries. That is, the first drive output part 113 with the smaller diameter possesses fewer gear teeth than the second drive output part 114 with the larger diameter.

Returning to FIGS. 4(*a*) and 4(*b*), the developing roller drive gear 120 is a rotary body serving to transmit a drive force inputted into the input gear 110 to the developing roller 71. The developing roller drive gear 120 is disposed on the end of the rotational shaft 71A provided in the developing roller 71 so as to rotate together with the developing roller 71. As will be described later, the developing roller drive gear 120 is formed with a wide axial dimension to account for the range in which the output gear part 112 moves when sliding axially (in the left-to-right direction).

The supply roller drive gear 130 is a rotary body serving to transmit a drive force inputted into the input gear 110 to the supply roller 72. The supply roller drive gear 130 is provided on the end of a rotational shaft 72A provided in the supply roller 72 so as to rotate together with the supply roller 72. The supply roller drive gear 130 includes a first drive input part 131 and a second drive input part 132 for receiving a drive force inputted from the input gear 110.

Both the first and second drive input parts 131 and 132 are gear parts having teeth formed around their outer peripheries. The first and second drive input parts 131 and 132 are provided on the end of the rotational shaft 72A and juxtaposed in the axial direction, with the second drive input part 132 closer to the outside of the developer cartridge 7. As shown in FIG. 5, the first and second drive input parts 131 and 132 have different rotational transmission diameters (pitch circle diameters). Consequently, the number of gear teeth provided around the outer peripheries of the first and second drive input parts 131 and 132 also differs. That is, the first drive input part 131 having the larger diameter possesses a larger number of gear teeth than the second drive input part 132 having the smaller diameter.

With the developer cartridge 7 according to the first embodiment, the input gear 110 is capable of sliding in the axial direction between the first engaging position in which the gear teeth of the first drive output part 113 are engaged (meshed) with the gear teeth on the first drive input part 131, as shown in FIG. 4(*a*), and the second engaging position in which the gear teeth of the second drive output part 114 are engaged with the gear teeth on the second drive input part 132, as shown in FIG. 4(*b*).

The gear teeth formed on the peripheries of the first drive output part 113, second drive output part 114, first drive input part 131, and second drive input part 132 are all tapered toward the opposing gears with which they engage and has a shape like a bevel gear. Specifically, in FIG. 4(*a*) the gear teeth on the second drive output part 114 (or second drive input part 132) are tapered toward the second drive input part 132 (or second drive output part 114) with which they engage. Further, in FIG. 4(*b*) the gear teeth on the first drive output part 113 (or first drive input part 131) are tapered toward the first drive input part 131 (or first drive output part 113) with which they engage. Accordingly, gear teeth that mesh with each other can engage smoothly.

As shown in FIG. 3, the intermediate gear 140 is rotatably provided on the main cartridge body 70B for transmitting a drive force inputted into the input gear 110 to the agitator drive gear 150. While not shown in the drawings, the intermediate gear 140, as with the developing roller drive gear 120, is formed with a wide axial dimension to account for the range in which the output gear part 112 moves when sliding axially.

The agitator drive gear 150 serves to transmit a drive force inputted into the input gear 110 to the agitator 75. The agitator drive gear 150 is provided on the end of a rotational shaft provided in the agitator 75 so as to rotate together with the agitator 75.

Next, the structure provided in the laser printer 1 for inputting a drive force into the developer cartridge 7 will be briefly described. As shown in FIG. 2, the laser printer 1 is provided with a motor M in the main casing 2 as a drive source, and an output coupling 9 for outputting a drive force from the motor M to the developer cartridge 7.

The output coupling 9 moves in association with the opening and closing of the front cover 21, for example, and is configured to advance toward and retract from the input coupling 111 of the developer cartridge 7 along its axial direction (left-to-right direction) when the developer cartridge 7 is mounted in the main casing 2. A solenoid actuator or the like may be used to switch the distance that the output coupling 9 of the first embodiment advances. In the first embodiment, the output coupling 9 can advance to two stages relative to the developer cartridge 7: the position shown in FIG. 4(*a*) and the position shown in FIG. 4(*b*).

For example, the laser printer 1 may be configured to allow a user to switch the advancing distance of the output coupling 9 (advanced position) by selecting a mode through operations on the laser printer 1. Specifically, when the user selects a "long-life mode" in the first embodiment, the output coupling 9 is advanced to the position shown in FIG. 4(*a*). When the user selects a "high-quality mode" the output coupling 9 advances to the position shown in FIG. 4(*b*).

In the first embodiment, the long-life mode is set as the default. Thus, when a user mounts the developer cartridge 7 in the main casing 2 and closes the front cover 21, the output coupling 9 first advances to the position shown in FIG. 4(*a*). If the user subsequently selects the high-quality mode, the output coupling 9 advances to the position shown in FIG. 4(*b*).

Next, the configuration of the developer cartridge 7 for changing the ratio of circumferential speeds of the supply roller 72 to the developing roller 71 will be described.

When the user selects the high-quality mode, the output coupling 9 advances from the position in FIG. 4(*a*) to the position in FIG. 4(*b*). As a result, the input gear 110 slidingly moves rightward against the urging force of the coil spring 77 until arriving in the second engaging position in which the second drive output part 114 is engaged with the second drive input part 132 of the supply roller drive gear 130. When the output coupling 9 is driven to rotate in this state, the input gear 110 also rotates, driving the developing roller drive gear 120 (developing roller 71) and supply roller drive gear 130 (supply roller 72) to rotate.

As illustrated in FIG. 5, the second drive output part 114 has a greater number of gear teeth (a larger diameter) than the first drive output part 113, while the second drive input part 132 has a fewer number of gear teeth (a smaller diameter) than the first drive input part 131. Therefore, the rotational speed (circumferential speed) of the supply roller 72 when the input gear 110 is in the second engaging position shown in FIG. 4(*b*) is faster than when the input gear 110 is in the first engaging position shown in FIG. 4(*a*). Since the circumferential speed of the developing roller 71 does not change in the first embodiment, the ratio of circumferential speeds of the supply roller 72 to the developing roller 71 is greater. This improves the ability of the supply roller 72 to scrape residual toner from the surface of the developing roller 71, making it possible to form high-quality images on the sheet S.

When the user selects the long-life mode, the output coupling 9 is retracted from the position in FIG. 4(*b*) to the position in FIG. 4(*a*). At the same time, the input gear 110 is slidingly moved leftward by the urging force of the coil spring 77 until arriving at the first engaging position in which the first drive output part 113 is engaged with the first drive input part 131 of the supply roller drive gear 130. When the output coupling 9 is driven to rotate in this state, the input gear 110 also rotates, driving the developing roller 71 and supply roller 72 to rotate.

As illustrated in FIG. 5, the first drive output part 113 has a fewer number of gear teeth (a smaller diameter) than the second drive output part 114, while the first drive input part 131 has a larger number of gear teeth (a larger diameter) than the second drive input part 132. Therefore, the circumferential speed of the supply roller 72 in the first engaging position is slower than when the input gear 110 is in the second engaging position shown in FIG. 4(*b*). However, since the circumferential speed of the developing roller 71 does not change in the first embodiment, the ratio of circumferential speeds of the supply roller 72 to the developing roller 71 is smaller. Consequently, the friction applied to toner between the developing roller 71 and supply roller 72 is reduced, increasing the life of the toner and, hence, increasing the life of the developer cartridge 7.

The developer cartridge 7 according to the first embodiment described above has the following operational advantages. The input gear 110 is configured to move in an axial direction relative to the supply roller drive gear 130 and can selectively be placed in a first engaging position for engaging the first drive output part 113 with the first drive input part 131, and a second engaging position for engaging the second drive output part 114 with the second drive input part 132. Since these positions change the circumferential speed of the supply roller 72, it is possible to modify the ratio of circumferential speeds of the supply roller 72 to the developing roller 71.

Since the gear teeth around the peripheries of the first drive output part 113, second drive output part 114, first drive input part 131, and second drive input part 132 have a tapered shape that tapers toward the opposing gear to which each gear is engaged, gear teeth mesh smoothly with each other when opposing gears are brought together.

By providing the coil spring 77 for urging the input gear 110, the engaging position of the input gear 110 can be switched by the output coupling 9, which advances and retracts similar to operations in the conventional technology, without requiring the laser printer 1 to have a special structure for slidingly moving the input gear 110 outward, for example. In other words, the coil spring 77 simplifies the structure for switching the engaging position of the input gear 110.

Next, a second embodiment of the present invention will be described, where like parts and components are designated with the same reference numerals to avoid duplicating description.

As shown in FIGS. 6(*a*) and 6(*b*), the drive transmission mechanism 76 according to the second embodiment is primarily configured of an input rotary body 210, a developing roller drive friction wheel 220, a supply roller drive gear 230, and an intermediate gear and agitator drive gear (both not shown in the drawings).

The input rotary body 210 primarily includes the input coupling 111, an output gear part 212, a first drive output part 213, and a second drive output part 214. By engaging directly with the supply roller drive gear 230, the output gear part 212 transmits the drive force inputted into the input rotary body 210 to the supply roller drive gear 230. Further, while not shown in the drawings, the output gear part 212 is engaged to the agitator drive gear via the intermediate gear and transmits a drive force inputted into the input rotary body 210 to the agitator drive gear.

As shown in FIG. 6(*c*), the first drive output part 213 is a friction wheel having a circular plate member CP, and a member having a high coefficient of friction provided around the periphery of the circular plate member CP (an endless rubber belt RB, for example). The first drive output part 213 is provided on the outside of the output gear part 212. When the input rotary body 210 is in the first engaging position shown in FIG. 6(*a*), the first drive output part 213 is in frictional contact (engaged) with a first drive input part 221 of the developing roller drive friction wheel 220 and transmits through friction a drive force inputted into the input rotary body 210 to the developing roller drive friction wheel 220.

The second drive output part 214 is a friction wheel having a construction similar to that of the first drive output part 213 and is disposed adjacent to and on the inside of the first drive output part 213. When the input rotary body 210 is in the second engaging position shown in FIG. 6(*b*), the second drive output part 214 is in frictional contact with a second drive input part 222 of the developing roller drive friction wheel 220 and transmits through friction the drive force inputted into the input rotary body 210 to the developing roller drive friction wheel 220.

The first drive output part 213 and second drive output part 214 have different diameters of rotational transmission (different diameters) and thus have different circumferential lengths. That is, the first drive output part 213 with the smaller diameter has a shorter circumferential length than the second drive output part 214 with the larger diameter.

The developing roller drive friction wheel 220 is a rotary body serving to transmit a drive force inputted into the input rotary body 210 to the developing roller 71. The developing roller drive friction wheel 220 includes the first drive input part 221 and second drive input part 222 for receiving a drive force from the input rotary body 210.

The first drive input part 221 and second drive input part 222 are friction wheels having structures similar to the first drive output part 213. The first drive input part 221 and second drive input part 222 are provided on the end of the rotational shaft 71A and juxtaposed in the axial direction, with the second drive input part 222 closer to the outside of the developer cartridge 7. The first drive input part 221 and second drive input part 222 have differing diameters of rotational transmission (differing diameters) and thus have different circumferential lengths. That is, the first drive input part 221 with the larger diameter possesses a greater circumferential length than the second drive input part 222 having the smaller diameter.

With the developer cartridge 7 according to the second embodiment, the input rotary body 210 is capable of sliding in the axial direction between the first engaging position shown in FIG. 6(*a*) in which the first drive output part 213 contacts the first drive input part 221, and the second engaging position shown in FIG. 6(*b*) in which the second drive output part 214 contacts the second drive input part 222.

The supply roller drive gear 230 is a rotary body serving to transmit a drive force inputted into the input rotary body 210 to the supply roller 72. In the second embodiment, the supply roller drive gear 230 is formed with a wide axial dimension to account for the range in which the output gear part 212 moves when sliding axially.

With the developer cartridge 7 according to the second embodiment described above, the circumferential speed of the developing roller 71 is less when the input rotary body 210 is in the first engaging position shown in FIG. 6(*a*) and greater when the input rotary body 210 is in the second engaging position shown in FIG. 6(*b*). In this way, it is possible to change the ratio of circumferential speeds of the supply roller 72 to the developing roller 71.

Since the circumferential speed of the developing roller 71 can be changed in the second embodiment, the ratio of circumferential speeds of the developing roller 71 to the photosensitive drum 61 (see FIG. 1) can also be changed. This makes it possible to adjust the amount of toner supplied from the developing roller 71 to the photosensitive drum 61, for example.

In the second embodiment, the friction wheels may be formed in a tapered shape that tapers toward an opposing friction wheel with which their outer peripheral surfaces engage. Further, while the first drive output part 213, second drive output part 214, first drive input part 221, and second drive input part 222 are configured of friction wheels in the second embodiment, these components may be configured of gears having gear teeth, as described in the first embodiment.

Conversely, while the first drive output part 113, second drive output part 114, first drive input part 131, and second drive input part 132 described in the first embodiment are configured of gears with gear teeth, these components may be configured of friction wheels, as described in the second embodiment.

In the first and second embodiments, the first and second drive input parts are provided only on one of the supply roller drive rotary body (supply roller drive gear 130) and the developing roller drive rotary body (developing roller drive friction wheel 220). In the third embodiment, the first and second drive input parts are provided on each of the supply roller drive rotary body and developing roller drive rotary body.

Figure 7B:
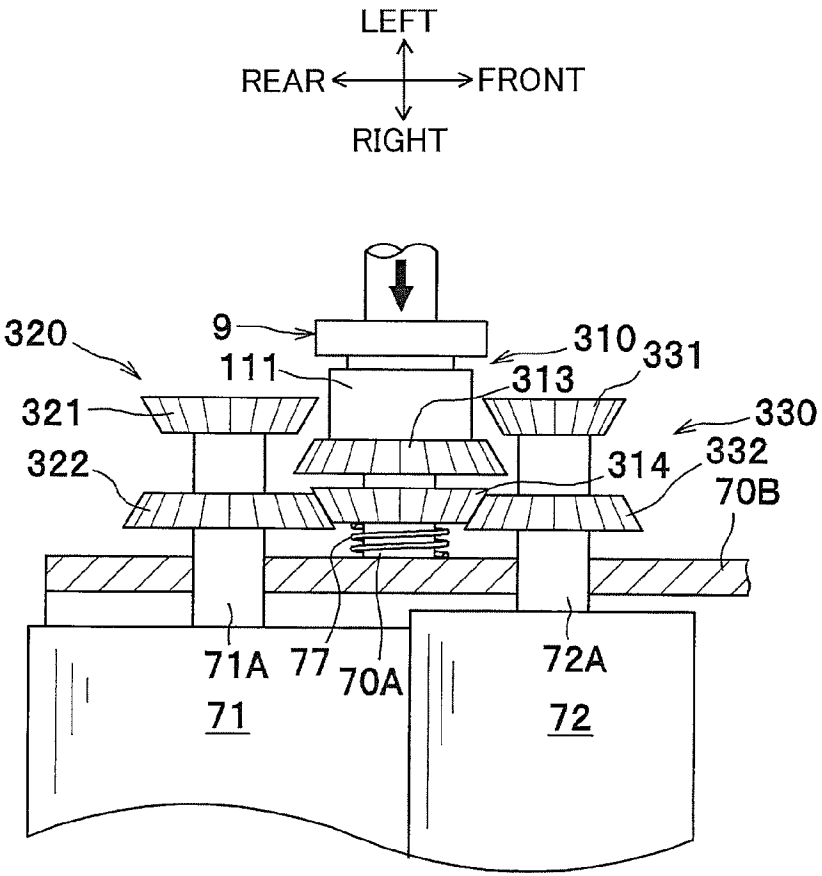
FIG. 7(*a*) is an explanatory diagram showing a developing roller, supply roller, input rotary body, developing roller drive rotary body, and supply roller drive rotary body that are provided in the cartridge according to the third embodiment when the input rotary body is positioned at the first position.
Figure 7A:
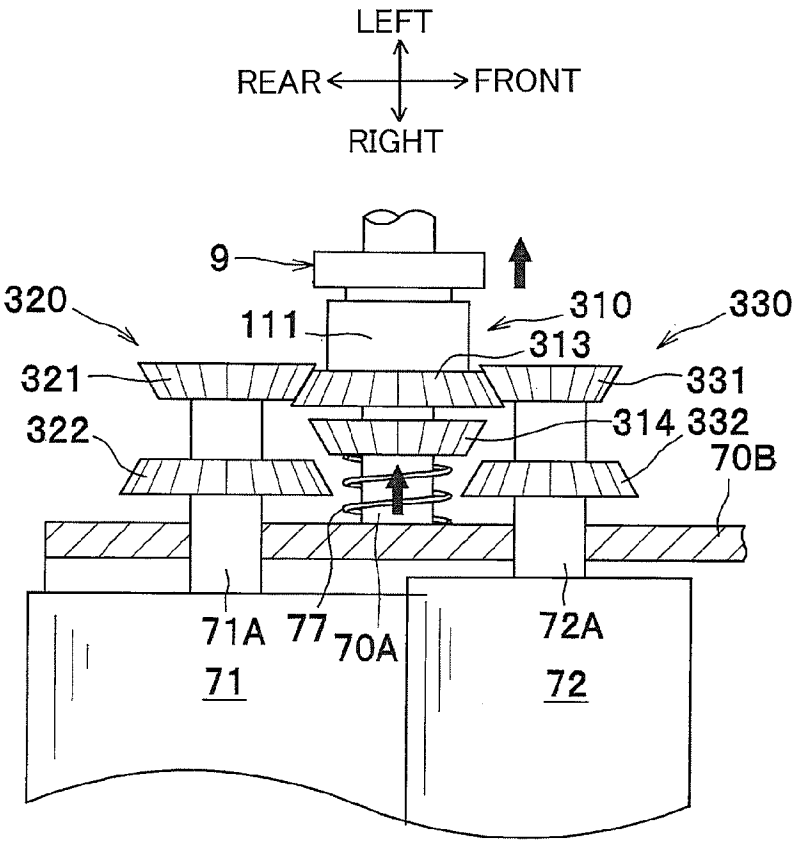

More specifically, as shown in FIGS. 7(*a*) and 7(*b*), the drive transmission mechanism 76 according to the third embodiment is primarily configured of an input gear 310, a developing roller drive gear 320, a supply roller drive gear 330, and an intermediate gear and agitator drive gear (both not shown in the drawings). The structure for transmitting a drive force to the agitator drive gear has also been omitted from FIG. 7.

The input gear 310 primarily includes the input coupling 111, a first drive output part 313, and a second drive output part 314. The first drive output part 313 and second drive output part 314 are gear parts having teeth formed on their outer peripheries. Both the first drive output part 313 and second drive output part 314 are disposed on the right end of the input coupling 111 and juxtaposed in the axial direction. The first drive output part 313 and second drive output part 314 have differing numbers of teeth provided around their peripheries (differing diameters of rotational transmission). That is, the first drive output part 313 with the larger diameter possesses a greater number of gear teeth than the second drive output part 314 with the smaller diameter.

The developing roller drive gear 320 includes a first developing-roller-side drive input unit 321 and a second developing-roller-side drive input unit 322, both possessing gear teeth around their peripheries. The first and second developing-roller-side drive input units 321 and 322 have differing numbers of gear teeth (differing diameters of rotational transmission). That is, the first developing-roller-side drive input unit 321 with the smaller diameter possesses fewer gear teeth than the second developing-roller-side drive input unit 322 with the larger diameter.

The supply roller drive gear 330 includes a first supply-roller-side drive input unit 331 and a second supply-roller-side drive input unit 332, both possessing gear teeth around their peripheries. The first and second supply-roller-side drive input units 331 and 332 have differing numbers of gear teeth (differing diameters of rotational transmission). That is, the first supply-roller-side drive input unit 331 with the smaller diameter possesses fewer gear teeth than the second supply-roller-side drive input unit 332 with the larger diameter.

In the third embodiment, the first developing-roller-side drive input unit 321 and first supply-roller-side drive input unit 331 also have differing numbers of gear teeth, as do the second developing-roller-side drive input unit 322 and second supply-roller-side drive input unit 332.

With the developer cartridge 7 according to the third embodiment described above, the input gear 310 is capable of sliding in the axial direction between the first engaging position shown in FIG. 7(*a*) in which the first supply-roller-side drive input unit 331 is engaged with both the first developing-roller-side drive input unit 321 and first supply-roller-side drive input unit 331, and the second engaging position shown in FIG. 7(*b*) in which the second drive output part 314 is engaged with both the second developing-roller-side drive input unit 322 and second supply-roller-side drive input unit 332.

As with the first and second embodiments, the developer cartridge 7 according to the third embodiment described above can change the ratio of circumferential speeds of the supply roller 72 to the developing roller 71 by slidingly moving the input gear 310 in the axial direction. Also, as in the second embodiment, the developer cartridge 7 according to the third embodiment can modify the circumferential speed of the developing roller 71, thereby changing the ratio of circumferential speeds of the developing roller 71 to the photosensitive drum 61.

In the third embodiment, the first drive output part 313, second drive output part 314, first developing-roller-side drive input unit 321, second developing-roller-side drive input unit 322, first supply-roller-side drive input unit 331, and second supply-roller-side drive input unit 332 all are configured of gears having gear teeth, but these components may be configured of friction wheels, as described in the second embodiment.

While the invention has been described in detail with reference to the first, second, and third embodiments thereof, it would be apparent to those skilled in the art that various changes and modifications may be made therein without departing from the spirit of the invention.

While the coil spring 77 is used as the urging member in the first, second, and third embodiments, the urging member of the present invention may be implemented by a spring member other than a coil spring, or elastomeric foam that is elastically deformable, for example.

In the first, second, and third embodiments, the user changes the ratio of circumferential speeds of the supply roller 72 to the developing roller 71 by selecting a mode through operations on the laser printer 1, but the present invention is not limited to this configuration. For example, the laser printer 1 may change (reduce) the ratio of circumferential speeds automatically when performing a warming up operation or other non-image-forming operation that involves rotating the developing roller 71 and supply roller 72.

In the first, second, and third embodiments, the ratio of circumferential speeds of the supply roller 72 to the developing roller 71 can be changed between two settings, but the ratio of circumferential speeds may be switched among three or more settings.

In the first, second, and third embodiments, all input rotary bodies having first and second drive output parts (the input gears 110 and 310, and the input rotary body 210) are configured to be slidable in the axial direction. However, the developer cartridge 7 in the preferred embodiments may be configured such that the input coupling 111 is immovable in the axial direction, while the first drive output part 113 and second drive output part 114 provided around the periphery of the input coupling 111 are capable of moving axially.

In the first, second, and third embodiments, the first and second drive output parts (the input gears 110 and 310 and the input rotary body 210) are capable of moving in a sliding manner along the axial direction relative to the first and second drive input parts (the first and second drive input parts 131, 132, 221, and 222, the first and second supply-roller-side drive input units 331 and 332), but the present invention is not limited to this configuration. For example, the first and second drive input parts may be configured to move slidingly in the axial direction relative to the first and second drive output parts. Alternatively, both the first and second drive input parts and the first and second drive output parts may be configured to move axially.

In the first, second, and third embodiments, the developer cartridge 7 is described as an example of the cartridge, but the present invention may also be applied to a process cartridge or the like in which the drum unit 6 and developer cartridge 7 of the preferred embodiments are integrally formed (unable to be detached from each other).

While the laser printer 1 serves as the image-forming device in which the cartridge of the present invention is mounted in the first, second, and third embodiments, the present invention may be applied to a printer for forming color images, for example. Further, the image-forming device of the present invention is not limited to a printer but may be a photocopier, multifunction peripheral, or the like provided with an original document reading device, such as a flatbed scanner.

What is claimed is:

1. A cartridge comprising:

a developing roller configured to carry developer thereon;

a supply roller in sliding contact with the developing roller to supply the developer to the developing roller;

an input rotary body configured to receive a drive force inputted from an image forming device to which the cartridge is detachably mounted;

a developing roller drive rotary body configured to transmit the drive force inputted from the input rotary body to the developing roller; and a supply roller drive rotary body configured to transmit the drive force inputted from the input rotary body to the supply roller;

wherein at least one of the developing roller drive rotary body and the supply roller drive rotary body includes:

a shaft extending in a shaft direction;

a first drive input part provided on the shaft and configured to receive the drive force inputted from the input rotary body, the first drive input part having a first rotational transmission diameter; and a second drive input part provided on the shaft at a location different from a location at which the first drive input part is provided and configured to receive the drive force inputted from the input rotary body, the second drive input part having a second rotational transmission diameter different from the first rotational transmission diameter;

wherein the input rotary body includes:

a first drive output part configured to engage with the first drive input part and transmit the drive force to the first drive input part, the first drive output part having a third rotational transmission diameter and a rotational axis defining an axial direction parallel to the shaft direction;

a second drive output part configured to engage with the second drive input part and transmit the drive force to the second drive input part, the second drive output part being coaxial with the first drive output part and positioned at a position different from a position at which the first drive output part in the axial direction, the second drive output part having a fourth rotational transmission diameter different from the third rotational transmission diameter;

wherein at least one of the first drive input part and the first drive output part is movable between a first position and a second position, the second drive input part being movable together with movement of the first drive input part, the second drive output part being movable together with movement of the first drive output part, the first drive input part and the first drive output part being engaged with each other when the at least one of the first drive input part and the first drive output part is positioned at the first position, the second drive input part and the second drive output part being engaged with each other when the at least one of the first drive input part and the first drive output part is positioned at the second position.

2. The cartridge according to claim 1, wherein the input rotary body is movable in the axial direction to move the first drive output part between the first position and the second position.

3. The cartridge according to claim 1, wherein each of the first drive input part, the second drive input part, the first drive output part, and the second drive output part has gear teeth, the drive force being transmittable from the first drive output part to the first drive input part by meshing gear teeth of the first drive input part with gear teeth of the first drive output part when the at least one of the first drive input part and the first drive output part is positioned at the first position, the drive force being transmittable from the second drive output part to the second drive input part by meshing gear teeth of the second drive input part with gear teeth of the second drive output part when the at least one of the first drive input part and the first drive output part is positioned at the second position.

4. The cartridge according to claim 3, wherein the gear teeth of the first drive input part and the gear teeth of the first drive output part are tapered toward each other and, the gear teeth of the second drive input part and the gear teeth of the second drive output part are tapered toward each other.

5. The cartridge according to claim 1, wherein the first drive output part and the first drive input part are in frictional contact with each other to transmit the drive force from the first drive output part to the first drive input part when the at least one of the first drive input part and the first drive output part is positioned at the first position, wherein the second drive output part and the second drive input part are in frictional contact with each other to transmit the drive force from the second drive output part to the second drive input part when the at least one of the first drive input part and the first drive output part is positioned at the second position.

6. The cartridge according to claim 2, further comprising an urging member configured to urge the input rotary body toward an outside of the cartridge in the axial direction.

7. The cartridge according to claim 1, wherein the first drive input part and the second drive input part are provided exclusively on the supply roller drive rotary body.

8. The cartridge according to claim 1, wherein the first drive input part and the second drive input part are provided exclusively on the developing roller drive rotary body.

9. The cartridge according to claim 1, wherein each of the supply roller drive rotary body and the developing roller drive rotary body includes the first drive input part and the second drive input part.

* * * * *